United States Patent [19]

Felsher

[11] 4,006,904

[45] Feb. 8, 1977

[54] DISPLAY DEVICE FOR PROJECTING SCENES, WIN SIGNALS, AND PROPORTION OF WIN SIGNALS

[76] Inventor: Edward M. Felsher, 5650 Hudson Ave., Montreal, Quebec, Canada

[22] Filed: Feb. 10, 1975

[21] Appl. No.: 548,777

[52] U.S. Cl. ..... 273/138 A

[51] Int. Cl.[2] ..... A63B 71/06

[58] Field of Search ..... 273/138 A, 139, 142 A, 273/142 B; 272/10, 8 P, 8.5, 9

[56] References Cited

UNITED STATES PATENTS

| | | | |
|---|---|---|---|
| 3,438,628 | 4/1969 | Becker et al. | 273/139 X |
| 3,466,775 | 9/1969 | Smith | 273/139 UX |
| 3,584,876 | 6/1971 | Segers | 273/138 A |
| 3,645,531 | 2/1972 | Wright | 273/138 A |
| 3,796,433 | 3/1974 | Fraley et al. | 273/138 A |

FOREIGN PATENTS OR APPLICATIONS

| | | | |
|---|---|---|---|
| 280,649 | 4/1967 | Australia | 273/138 A |
| 409,617 | 2/1971 | Australia | 273/138 A |
| 1,178,302 | 1/1970 | United Kingdom | 273/138 A |

*Primary Examiner*—Anton O. Oechsle
*Assistant Examiner*—Arnold W. Kramer
*Attorney, Agent, or Firm*—Diller, Brown, Ramik & Wight

[57] ABSTRACT

The invention relates to a display device for use in a game, which display device includes a display area for displaying scenes such as commercial messages, and which display device includes means for selecting winners and determining the proportion of the win in association with preselected scenes. The device includes a slide projector for containing representations of a plurality of the scenes, for applying the scenes one at a time to the display area, and for advancing the representations applied on receipt of a signal. A winner display area and a proportion of win display area are also included on the face of the display device.

1 Claim, 6 Drawing Figures

DISPLAY DEVICE FOR PROJECTING SCENES, WIN SIGNALS, AND PROPORTION OF WIN SIGNALS

BACKGROUND OF THE INVENTION

1. Field of the Invention

The invention relates to a display device for use in a game which device displays commercial messages and selects and announces winners. More specifically, this invention relates to such a display device wherein the selection and announcement of the winners is associated with preselected commercial messages.

2. Discussion of the Prior Art

There are many display devices available for displaying commercial messages such as billboards, TV, promotion displays, etc. In addition, there are many games played, for example, in supermarkets, and means are provided for announcing the winners of these games. However, to applicants's knowledge, there are no games wherein commercial messages are displayed and wherein the selection and announcement of a winner is a function of the commercial message being announced or selected.

SUMMARY OF THE INVENTION

Although in the above the words "commercial message" were used, it will be appreciated that any scene could be displayed, and to preserve the generality, the word scene will be used in the following.

In accordance with the invention, a display device for displaying one of a plurality of scenes, comprises, a scene display area and means for containing representations of the plurality of scenes, for applying one of the scenes at a time on the scene display area, and for advancing the representations applied on receipt of a scene advancing signal. Means are also provided for providing a win signal in association with preselected scenes; and further means are provided for providing a proportion of win signals in association with preselected ones of the aforesaid preselected scenes.

A device may further comprise a winner display area and a proportion of win display area, the win signal being adapted to actuate the winner display area, and the proportion of win signal being adapted to actuate the proportion of win area.

In addition, the device can include audio output means adapted to be actuated by the win signal.

In a preferred embodiment, the means for containing comprises a slide projector, and the display area comprises a projector screen. The representations of the scenes are contained on slides mounted in the slide projector and the slide projector is adapted to advance the slides one at a time into a project position wherein the scene representation on the slide in the project position is projected onto the screen.

In the preferred embodiment, each of the slides comprises a plurality of markings on an end thereof, and a plurality of spring contacts are mounted in the device such that each spring contact is adjacent a respective marking when the slide is in the project position. Conductive clips are provided for mounting on selected ones of said markings, the spring contacts being adapted to contact a clip on its respective marking when the slide carrying the mounting is in the project position. The spring contacts are adapted to provide respectively the win or a respective proportion of win signal when they are in contact with their respective clips.

BRIEF DESCRIPTION OF THE DRAWINGS

The invention will be better understood by an examination of the following description together with the accompanying drawings in which.

DETAILED DESCRIPTION OF THE DRAWINGS

In order to better understand the invention, a brief description of the rules of the game in which the display device is used is in order. In one aspect, the game is used in supermarkets with the dual function of advertising products sold in the store and providing incentive for the customers to shop in the store, or in a chain of stores, by providing prizes proportional to the amount of an order being purchased. As the prize in proportional to the order size, the customer is also encouraged to increase the size of his order.

In a supermarket game, when the cashier punches the total of the order, a new scene may appear on the display area of the display device. The change in scene may be initiated either by a switch in the cash register, or an externally located switch as discussed below. The switch may be initiated on any order or on orders above a minimum value, i.e. $10.00.

If the scene is a price winning scene, the WINNER area will light up, and aural indications, such as the ringing of a bell, will be presented. At the same time, the device displays the proportion of the order that is won by the customer. If this proportion is, say 20%, then the customer only has to pay 80% of his order cost.

Figure 1:
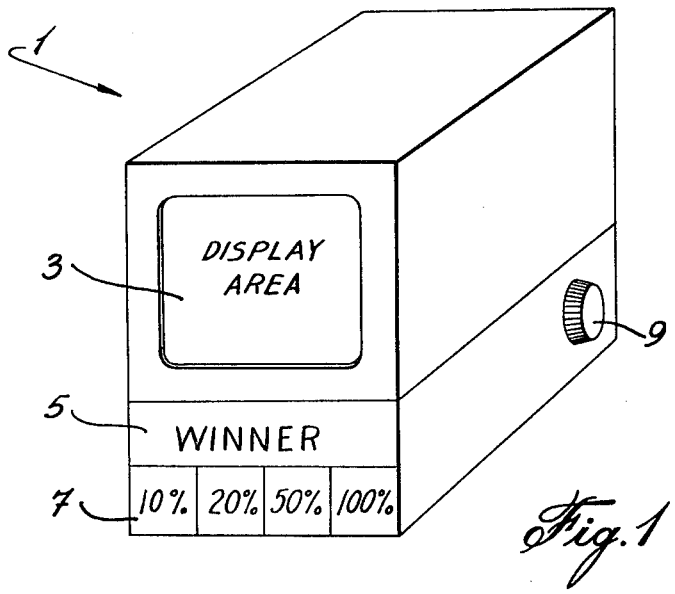
FIG. 1 is a perspective view of the display device.

Referring now to FIG. 1, the display device, indicated generally at 1, comprises a display area 3 for displaying scenes such as commercial messages. It will be appreciated that the scenes can be pictorial or comprise words or numbers as desired. In addition, the scenes can be in black and white or in color as required.

A winner announcement 5 lights up when a winner is selected, as will be described below, and the proportion of winnings is flashed in the area 7. Although FIG. 1 shows four separate blocks for flashing four separate proportions, it is of course understood that the entire area can flash only one proportion at a time as is well known in the art.

Means for providing a light up of the winner and proportion areas are well known in the art and require very little elaboration here. Thus, the area 5 could comprise a glass plate with the word winner painted on it. A light bulb is contained behind the glass plate and is activated on signal to light up this area.

In the area 7, photo-electric devices with logic circuits for activating the appropriate messages on signal could be provided. Or NIXIE (TM) lights could be used with appropriate logic circuits.

An audio sound can be produced on a speaker, shown schematically at 9, to direct attention to the display device.

Figure 2:
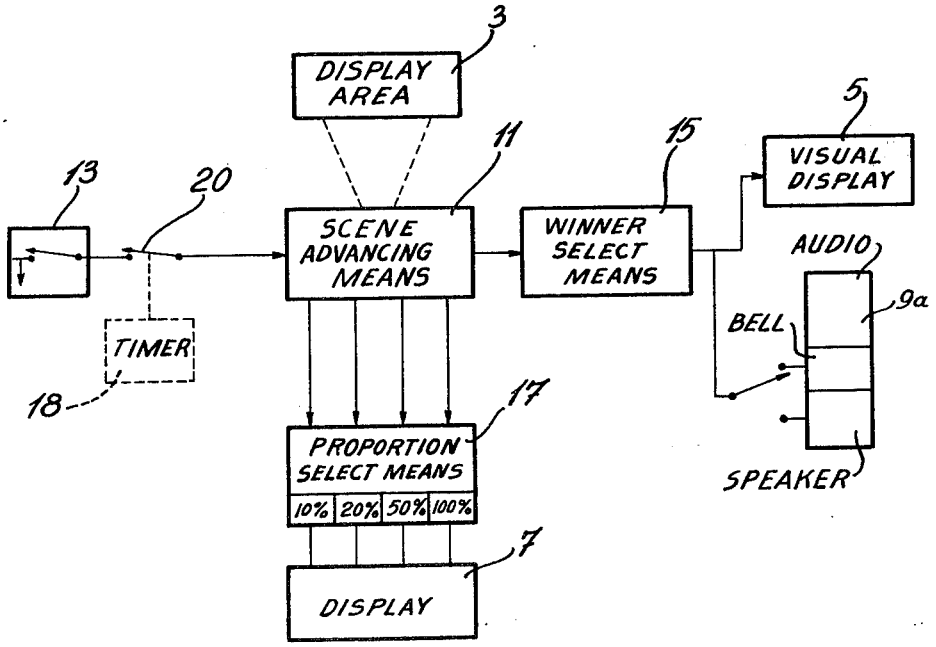
FIG. 2 is a block diagram of the electronics for the operation and control of the display device.

Referring to FIG. 2, a scene advancing means 11, which also provides a scene, on the display area 3, is actuated by the switch 13 to advance the scene (except when the timer 18 is used as will be discussed below) provided to the display area. The switch 13 can comprise the TOTALS switch on a cash register, or it can be, preferably, a separated switch operated by hand or foot. In FIG. 2, the switch is shown, schematically, to apply a ground to the scene advancing means.

The scene advancing means, specific structures of which will be discussed below, comprises a series of scene representations, and preselected ones of these will comprise means for selecting a winner and further means for determining the proportion of the win in one embodiment. In another embodiment, the scene advancing means per se is instrumental in selecting a winner and the proportion of the win. In all cases, means are provided for selecting a winner in association with preselected scenes, and different win proportions are assigned to different preselected scenes of the aforesaid preselected scenes.

When a winning scene is advanced, winner select means 15 is actuated which in turn actuates the visual and audio display means 5 and 9*a* respectively. At the same time, the proportion select means 17 is actuated to actuate in turn the appropriate proportion readout.

In one embodiment, the scene advancing means will comprise a slide projector with an arrangement for automatically presenting a new slide when a switch is actuated. In this embodiment, the display area will comprise a projector screen as well known in the art, and representations of the scenes are included on the film slides mounted in the projector. A rotary slide projector is preferable, although a linear slide advance means is usable in accordance with the invention.

Figure 3:
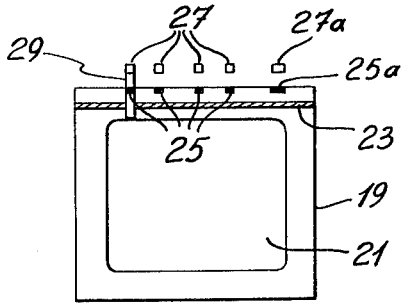
FIG. 3 is a film slide modified for operation with a display device in accordance with one embodiment of the invention.
Figure 4:
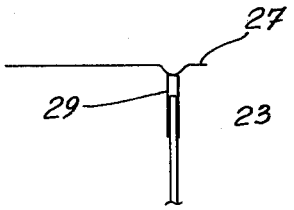
FIG. 4 is a side view of FIG. 3.

When a slide projector is used, the film slides are modified as shown in FIGS. 3 and 4. Referring to these figures, a film slide 19, which includes a transparency area 21 for containing the scene representation, is modified with a ground bar 23 which comprises a conductive bar connected to a grounded point, not shown. It will, of course, be appreciated that the bar 23 could be connected to a point of high potential, or some other point, instead of the grounded point.

One end of the slide, the top end in FIG. 3, comprises a plurality of markings 25 and 25*a*, each of the markings, when the slide is mounted in the projector in the display device, being disposed adjacent a respective spring contact 27. The marking 25*a* is used to designate a winner in association with the contact 27*a*, and the remainder of the markings 25 are used to designate respective proportions as will be discussed below.

If a scene is selected as a winning scene, a conductive clip 29 is mounted on the marking 25*a* and a further clip is mounted on the appropriate proportion marking such that the first clip will make contact with the spring contact 27*a* and the second clip will make contact with the associated spring contact 27 when the selected scene is in the projecting position. This is best seen in FIG. 4.

Figure 5:
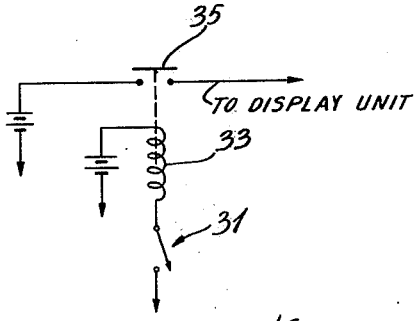
FIG. 5 illustrates schematically the electrical connections of FIGS. 3 and 4.

Referring to FIG. 5, 31 represents a single clip 29 and spring contact 27 arrangement, and each such arrangement is connected to one end of a separate relay 33. The other end of each relay is connected to a source of potential. Contact of the clip 29 with the spring 27 will place 27 at ground potential by virtue of the ground bar 23, so that the relay 33 will be energized. The movable contact 35 of the relay, is in a line between a source of potential and a win or respective proportion of win display means. When the respective relay is energized, power will be supplied to its respective display means to activate the display means. Thus, if we consider the spring 27*a* and the marking 25*a*, when a conductive clip 29 is mounted on the marking 25*a* of a preselected slide, and when that slide is in the project position, the clip will contact 27*a* to place 27*a* at ground potential. Thus, a ground is provided to the relay to which 27*a* is connected, and the relay will be energized to close its contact 35. If the win display means comprises a light bulb, as above described, power will now be supplied to the bulb so that the bulb will be turned on.

In operation, winning scenes are preselected and the winning proportions of the winning scenes are also preselected, and clips are appropriately mounted on the winning scene markings at the respectively proportion marking. When a winning scene appears in the projection position of the scene advancing means, the clips will contact the springs to actuate the winner and appropriate proportion areas.

Although one physical contact system has been described, it will be appreciated that other such systems could be used, for example, micro-switches. In addition, an optical system could be used, e.g., holes could be punched in the frame of the slide to operate in conjunction with photoelectric cells. Again, separate hole locations would be provided for the WINNER position and for each of the proportion of win positions. Magnetic switching systems, also well known in the art, could also be used.

Figure 6:
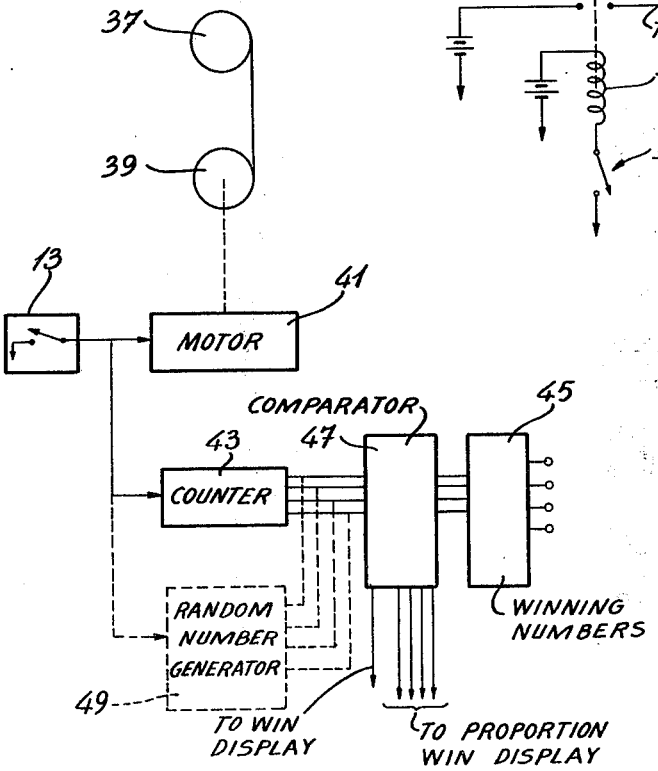
FIG. 6 illustrates an alternative embodiment of a scene advancing means.

In a further embodiment, shown in FIG. 6, a series of scene representations is contained in the roll 37, which could be a roll of movie film or a large paper roll with the scenes imprinted thereon. If the roll is movie film, then it will of course be mounted in a movie projector, and the display area will be a movie screen. If paper, then the selected scene will be directly in the display area, and the displayed scene and the representation thereof will be one and the same item. A take up roll 39 is driven by step by step motor 41 which drives the roll one scene or frame at a time. The motor 41 is actuated each time the switch 13 is depressed, and the counter 43 counts the number of depressions of the switch.

A winner number is set by hand with the numbers of the winning scenes, and the means 45 translates the numbers to electronic representations. The number on the counter is compared with the numbers in 45, and when a correct number appears in 43, signals are provided to the winner and proportion display areas. With respect to the proportions, each number set in 45 will also contain a code representative of a selected proportion.

In order to provide randomness, a timer 18 (FIG. 2) is used in the system. The timer will open switch 20 for random intervals at randomly spaced times, and when switch 20 is open, then the scenes will not be advanced on actuation of the switch 13. Thus, although it is known which scene is a winning scene, it is not known when the scene will appear. The timer 18 can be used with both the FIG. 2 and the FIG. 6 embodiments.

To provide randomness in the FIG. 6 embodiment in a different way, the counter 43 is replaced with a random number generator 49. Each time the switch 13 is pressed, a different random number is generated, and the random number is compared with numbers set into means 45. In all other respects, the system operates as previously described.

Although the systems described have contemplated the use of stationary scenes advanced by the input signal, it will be apparent that the invention could be practiced with continuously changing scenes wherein the input signal would stop the scenes rather than advancing them. The information concerning winners and proportion of win would still be contained or preselected scenes as above.

The scene advancing means could comprise a movie camera or a video tape playback unit, and the information concerning winners and proportion of win would be encoded on the scene by white and black dots or squares to be picked up by photo-electric cells.

Although several embodiments have been described, this was for the purpose of illustrating, but not limiting, the invention. Various modifications, which will come readily to the mind of one skilled in the art, are within the scope of the invention as defined in the appended claims.

I claim:

1. A display device for displaying one of a plurality of scenes, and comprising;

a slide projector for containing representations of said plurality of scenes on slides mounted in said slide projector, a display area comprising said projector screen, means for projecting one of said slides at a time on said projector screen, and, means for advancing said slides into the project position on receipt of a scene advancing signal from a signal means;

means associated with preselected scenes for activating a win signal;

means associated with preselected ones of said preselected scenes for activating a proportion of win signal;

display means for displaying a win signal and a plurality of further display means for displaying respective proportions of win signals;

wherein, each slide comprises a plurality of markings on an end thereof;

a conductive bar on each slide connecting all of said markings, said conductive bar being connected to ground potential;

a plurality of spring contacts mounted in said slide projector such that each spring contact is adjacent a respective marking when the slide is in the project position:

each of said contacts being connected to one end of a respective relay, the other end of the relay being connected to a source of potential;

and conductive clips for mounting on selective ones of said markings of said preselected slides;

said spring contacts being adapted to contact the clip on its respective marking when the slide, carrying the marking, is in its project position;

whereby, when a contact is grounded through a conductive clip by said conductive bar, its respective relay will be energized;

the movable contacts of each said relay being in a conductive path between a source of potential and an associated win or respective proportion of win display means;

whereby, when a respective relay is energized, power will be supplied to its associated display means to energize said associated display means;

and further comprising:

conductive means connecting said signal means with said means for advancing;

switch means inserted in said conductive means;

timer means connected to said switch means and adapted to open said switch means when said timer means is activated whereby to prevent said means for advancing from receiving said signal, said switch means being closed when said timer is not activated;

whereby to introduce an element of time randomness in the advancement of said representations.

* * * * *